US007434335B2

(12) United States Patent
Feldstein

(10) Patent No.: US 7,434,335 B2
(45) Date of Patent: Oct. 14, 2008

(54) TAP SHOE WITH ADJUSTABLE TAP ASSEMBLY

(76) Inventor: Jeffrey Feldstein, 2220 east Main St., Richmond, VA (US) 23223

( * ) Notice: Subject to any disclaimer, the term of this patent is extended or adjusted under 35 U.S.C. 154(b) by 624 days.

(21) Appl. No.: 10/987,103

(22) Filed: Nov. 15, 2004

(65) Prior Publication Data

US 2005/0138840 A1 Jun. 30, 2005

Related U.S. Application Data

(60) Provisional application No. 60/531,989, filed on Dec. 24, 2003.

(51) Int. Cl.
*A43B 5/12* (2006.01)

(52) U.S. Cl. ..... 36/8.3; 36/15; 36/31

(58) Field of Classification Search ..... 36/8.3, 36/131, 134, 67 D, 15, 31
See application file for complete search history.

(56) References Cited

U.S. PATENT DOCUMENTS

| | | | | |
|---|---|---|---|---|
| 2,161,497 | A | 6/1939 | Yates | |
| 2,443,727 | A | 6/1948 | Dumont et al. | |
| 2,746,175 | A | 5/1956 | Root | |
| 4,463,506 | A | 8/1984 | Isackson | |
| 4,468,871 | A | 9/1984 | Winn | |
| 4,513,519 | A | 4/1985 | Hedrick | |
| 4,625,436 | A | 12/1986 | Stevens, Jr. | |
| D293,161 | S | 12/1987 | Stevens, Jr. | |
| 5,459,946 | A | 10/1995 | Rayow | |
| 6,389,712 | B1 * | 5/2002 | Schelling | 36/15 |
| D464,475 | S | 10/2002 | Isackson et al. | |
| 6,598,317 | B1 | 7/2003 | Le Vine et al. | |
| 6,711,833 | B1 | 3/2004 | Ransan | |
| 6,826,851 | B2 * | 12/2004 | Nelson, Jr. | 36/50.1 |
| 2004/0064971 | A1 | 4/2004 | Isackson et al. | |

FOREIGN PATENT DOCUMENTS

| | | |
|---|---|---|
| EP | 0 766 931 A1 | 4/1997 |
| JP | 2003-228371 | 8/2003 |

* cited by examiner

*Primary Examiner*—Jila M Mohandesi
(74) *Attorney, Agent, or Firm*—Richard C. Litman

(57) ABSTRACT

The tap shoe with an adjustable tap assembly facilitates changing taps and can be used to alter the sound of the tap. The tap shoe with an adjustable tap assembly is a tap shoe having a toe portion and a heel, two taps, two metal spacer plates, machine screws, and nuts. The nuts are embedded in the heel and toe portion of a tap dancing shoe. The spacer plates are attached to the heel and toe portions, respectively, with adhesive and nails. Machine screws then secure the taps to the nuts in the toe portion and heel of a tap dancing shoe, being inserted through holes in the spacer plates. Self-locking nuts are used to eliminate the possibility of the machine screws vibrating loose.

6 Claims, 5 Drawing Sheets

TAP SHOE WITH ADJUSTABLE TAP ASSEMBLY

CROSS-REFERENCE TO RELATED APPLICATION

This application claims the benefit of U.S. Provisional Patent Application Ser. No. 60/531,989, filed Dec. 24, 2003.

BACKGROUND OF THE INVENTION

1. Field of the Invention

The present invention relates to tap dancing shoes, and particularly to a tap shoe with an adjustable tap assembly that facilitates changing taps and can be used to alter the sound of the tap.

2. Description of the Related Art

A tap shoe utilized in tap dancing has a tap attached to the front of the shoe, referred to as the "toe box." A second tap is attached to the heel of the tap shoe. Tap shoes can be either specialty dance shoes or street shoes with taps attached. Typically the taps are attached to the sole of the shoe using wood screws or nails. In order to have screws adequately hold the tap to the sole of the shoe a thin fiberboard spacer is often glued and tacked to the toe box and the heel.

Unfortunately, vigorous tapping can vibrate the screws loose from the tap shoe. Repeatedly removing taps or adjusting the tightness of the tap to the sole of the shoe can wear out the internal threads in the sole and render the shoe useless for tap dancing. Some tap dancers wrap the screws that hold the taps in place with steel wool or apply a thread locker or adhesive resin to the screws, but this is often a temporary, inadequate remedy.

One of the reasons a tap dancer would tighten or loosen a tap to the sole of their shoes would be to alter the sound that the tap makes when it strikes a dance floor. As stated above, most conventional tap shoes have a fiberboard spacer between the tap and the sole of the tap shoe. Because tone quality is a function of metal on metal, the fiberboard spacer deadens the sound of the tap shoe, making it more difficult to vary the sound of the tap. Various efforts have been made to improve the sound quality, e.g., Japanese Patent No. 2003-228,371, published Aug. 15, 2003, describes providing the tap shoes with microphones. However, none of these efforts have proven entirely satisfactory. Thus, a tap shoe with an adjustable tap assembly solving the aforementioned problems is desired.

SUMMARY OF THE INVENTION

The tap shoe with an adjustable tap assembly facilitates changing taps and can be used to alter the sound of the tap. The tap shoe with an adjustable tap assembly is a tap shoe having a toe portion and a heel, two taps, two spacer plates, machine screws, and nuts. The nuts are embedded in the heel and toe portion of a tap dancing shoe. The spacer plates are attached to the heel and toe portions, respectively, with adhesive and nails. Machine screws then secure the taps to the nuts in the toe portion and heel of a tap dancing shoe, being inserted through holes in the spacer plates. Self-locking nuts are used to eliminate the possibility of the machine screws vibrating loose. By adjusting the tightness of the metal screws, a tap dancer may tune their taps to meet various acoustical needs. The spacer plates are constructed out of metal to improve the tonal quality of the taps when they strike a dance floor.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
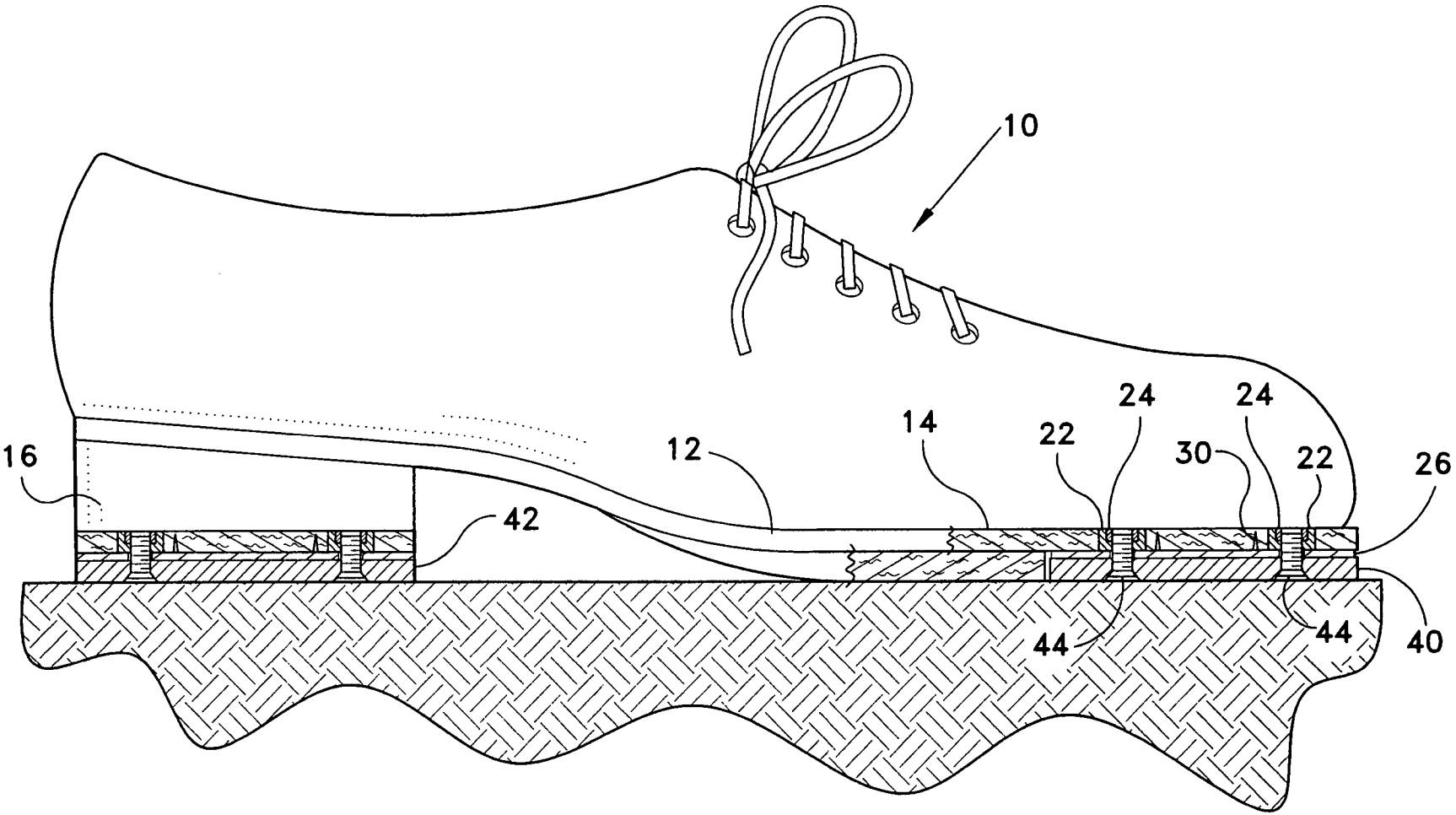
FIG. 1 is a side view in partial section of a tap shoe with adjustable tap assembly according to the present invention.
Figure 2:
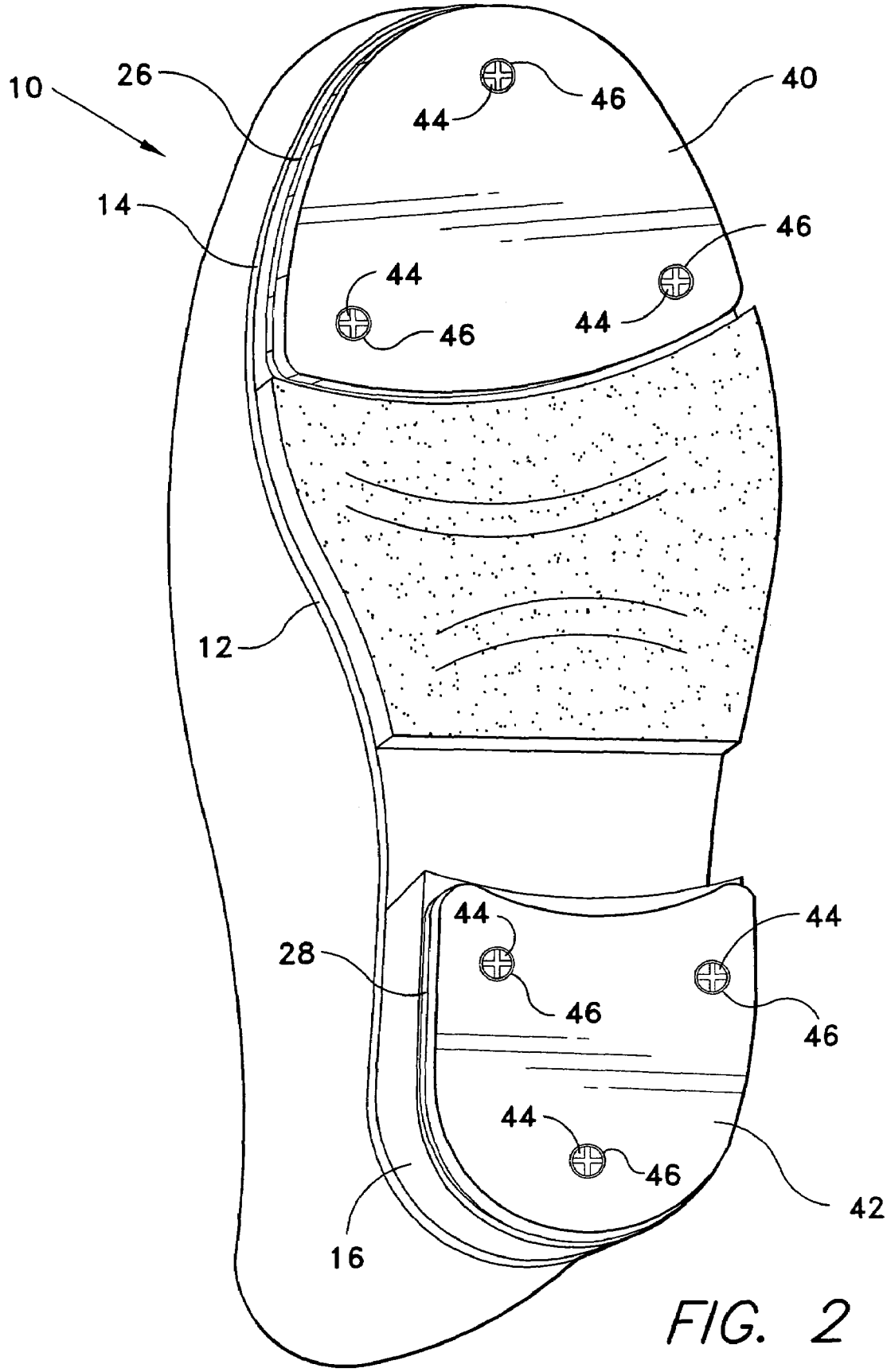
FIG. 2 is a perspective view of a tap shoe with adjustable tap assembly according to the present invention as viewed from the bottom of the shoe.
Figure 3:
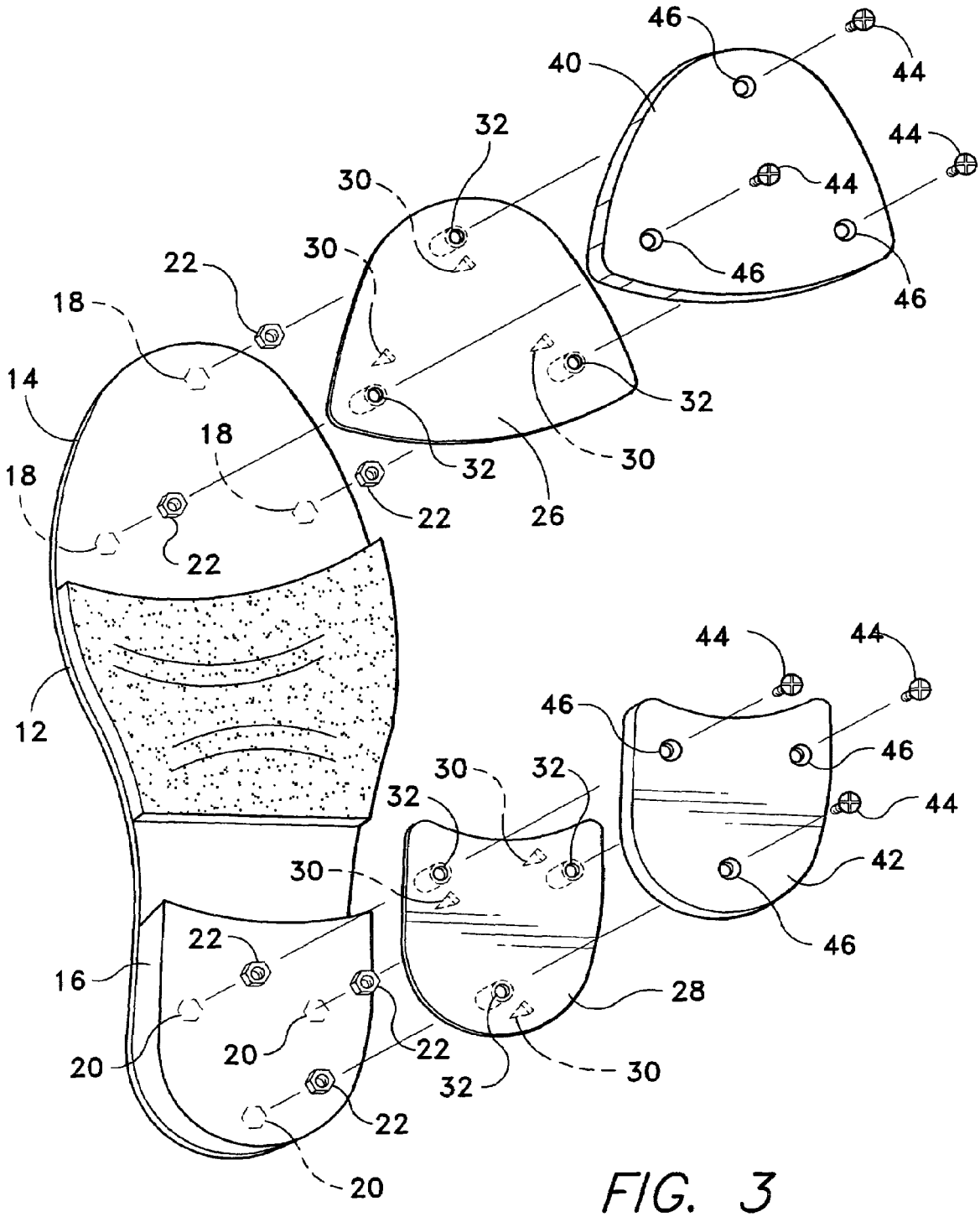
FIG. 3 is a bottom perspective view of a tap shoe according to the present invention with adjustable tap assembly exploded from the heel and sole of the shoe.
Figure 4:
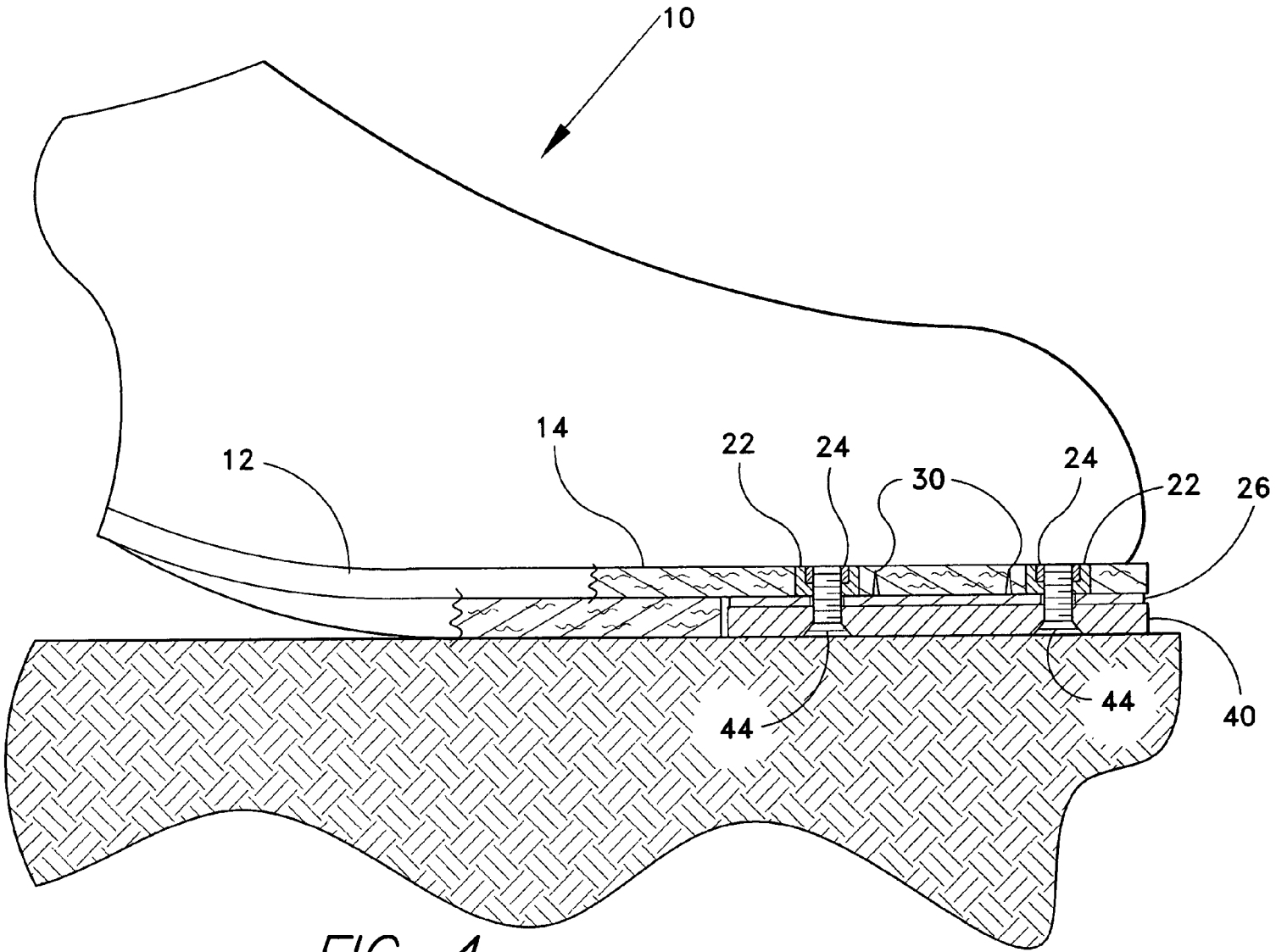
FIG. 4 is a fragmented side view of the toe portion of the tap shoe of the present invention in partial section.
Figure 5:
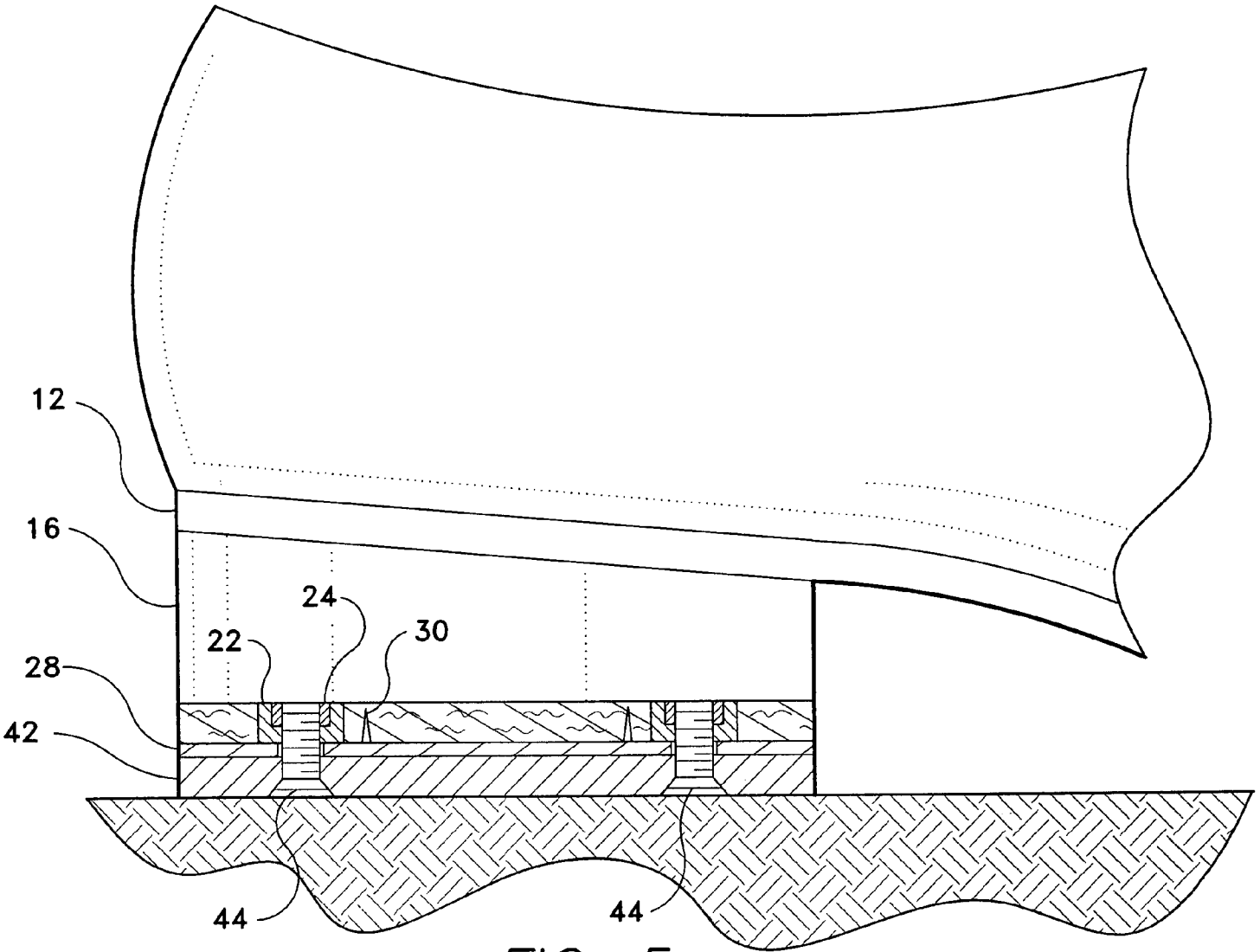
FIG. 5 is a fragmented side view of the heel of the tap shoe of the present invention in partial section.

The present invention is a tap shoe with an adjustable tap assembly, referred to generally as 10 in the drawings, and a method of attaching an adjustable tap assembly to a tap shoe. As shown in FIGS. 1-3, the tap shoe 10 has a sole 12, a toe portion 14 at the front of the sole 12, and a heel 16 attached to the rear of the sole 12. The toe portion 14 of the sole 12 has three circular openings 18 defined therein. The heel 16 also has three circular openings 20 defined therein. Nuts 22 are inserted in to the openings 18, 20 and embedded therein. In the embodiment shown in FIGS. 1-5, the nuts 22 are hexagonal self-locking nuts, of a type commonly referred to under the trade name "Nylock Nuts." FIGS. 4 and 5 show the plastic nylon insert 24 that makes the nuts 22 self-locking. By using nuts 22 that are hexagonal and slightly larger than the openings 18, 20, when the nuts 22 are inserted into the openings 18, 20 they are frictionally held in place. It is contemplated that other securing means and types of nuts could be used with the present invention.

The next component of the tap shoe 10 is a first spacer plate 26 that is tacked, using nails or tacks 30, and glued below the toe portion 14. A second spacer plate 28 is tacked, using nails or tacks 30, and glued below the heel 16. The first spacer plate 26 and second spacer plate 28 have openings 32 that correspond to the circular openings 18, 20 in the toe portion 14 and heel 16, respectively. In one embodiment, the first spacer plate 26 and the second spacer plate 28 are made of metal. By using a metal spacer plate instead of the traditional fiberboard spacer, also referred to as a "sleeve," the tap has a metal on metal contact that increases the tonal quality of the tap when it strikes the dance floor.

The toe tap 40 and the heel tap 42 are secured to the toe portion 14 and the heel 16 using machine screws 44. The tap shoe with adjustable tap assembly 10 may have multiple taps in various colors. The toe tap 40 and the heel tap 42 have three countersunk holes 46 that correspond to the circular openings 18, 20 in the toe portion 14 and heel 16. As shown in FIGS. 4 and 5, the holes 46 are countersunk so that the heads of the machine screws 44 do not protrude from the lower surface of the tap, as shown in FIG. 2. The use of machine screws 44 and nuts 22 eliminates the wear that the sole of a tap shoe experiences when the more traditional wood screws are used to secure a tap in place. The use of machine screws 44 and nuts 22 also makes it easier to change out taps quickly and efficiently. Further, the use of machine screws 44 and nuts 22 allows for more precise adjustment of the tightness of the tap so that a user may adjust the sound of the tap when it strikes the dance floor to a particular acoustic level.

Although the shoe 10 is shown having a heel 16 attached to the sole 12 in the drawings, it will be understood that the scope of the present invention extends to shoes in which the shoe does not have a heel and the tap is attached directly to the rear portion of the sole 12. Further, although Nylock nuts 22 are shown in the drawings, other types of self-locking nuts, e.g., clinch nuts, may be substituted therefor.

It is to be understood that the present invention is not limited to the embodiment described above, but encompasses any and all embodiments within the scope of the following claims.

I claim:

1. A tap shoe with adjustable tap assembly, comprising:

a sole having an upper attached thereto defining a shoe, the shoe having a toe portion and a heel portion, the heel portion including a heel fixed to the sole;

a plurality of self-locking nuts embedded in the toe portion;

a plurality of self-locking nuts embedded in the heel;

a metal toe tap;

a first spacer plate fixed to the toe portion of the shoe beneath the toe tap, the first spacer plate being made from metal;

a metal heel tap;

a second spacer plate fixed to the heel of the shoe beneath the heel tap, the second spacer plate being made from metal; and, a plurality of machine screws removably and adjustably securing the first and second spacer plates and the toe and heel taps to the toe and heel portions of the shoe, whereby adjustment of the screws permits a tap dancer to adjust sound and tonal quality of the toe and heel taps upon striking a dance floor.

2. The tap shoe according to claim 1, wherein said self-locking nuts are Nylock nuts.

3. A method of adjustably securing a tap to a tap shoe, the tap shoe including a sole having a toe portion, a heel portion, a metal toe tap and a metal heel tap, said method comprising the steps of:

embedding a plurality of self-locking nuts into the toe and heel portions of the shoe;

fixing a first metal spacer plate to the toe portion of the shoe over the self-locking nuts;

fixing a second metal spacer plate to the heel portion of the shoe over the self-locking nuts;

inserting a plurality of threaded fasteners through aligned holes in the toe and heel taps and the metal spacer plates and securing the threaded fasteners in self-locking nuts embedded into the toe and heel portions of the shoe: and selectively adjusting depth of the treaded fasteners in the self-locking nuts in order to adjust audible quality of the toe and heel taps when a tap dancer strikes a dance floor.

4. The method of adjustably securing a tap to a tap shoe according to claim 3, further comprising the step of replacing the tap with a tap of a different color in order to match the color of the tap with the color of the shoe.

5. The method of adjustably securing a tap to a tap shoe according to claim 3, wherein the self-locking nuts are Nylock nuts.

6. The method of adjustably securing a tap to a tap shoe according to claim 3, wherein the threaded fasteners are machine screws.

* * * * *